United States Patent [19]

Wright et al.

[11] Patent Number: 4,577,454

[45] Date of Patent: Mar. 25, 1986

[54] VALVE BAG PLACING MACHINE AND METHOD

[75] Inventors: Paul R. Wright; Dale A. Hill, both of Humboldt, Iowa

[73] Assignee: Douglas & Lomason Company, Farmington Hills, Mich.

[21] Appl. No.: 615,752

[22] Filed: May 31, 1984

[51] Int. Cl.[4] ..... B65B 43/30

[52] U.S. Cl. ..... 53/492; 53/386; 53/459; 53/573

[58] Field of Search ..... 53/573, 572, 374, 375, 53/390, 492, 459, 386

[56] References Cited

U.S. PATENT DOCUMENTS

| | | | |
|---|---|---|---|
| 3,287,879 | 11/1966 | Miller, Jr. . | |
| 3,312,038 | 4/1967 | Knauf | 53/573 |
| 3,430,409 | 3/1969 | Manfredonia et al. . | |
| 3,673,759 | 7/1972 | Ayres et al. . | |
| 3,691,715 | 9/1972 | Kelly et al. . | |
| 3,715,858 | 2/1973 | Durant et al. . | |
| 3,785,414 | 1/1974 | Obara . | |
| 3,830,038 | 8/1974 | Propst . | |
| 3,884,278 | 5/1975 | Nakashima . | |
| 3,943,687 | 3/1976 | Cerioni . | |
| 3,945,173 | 3/1976 | Buzzi . | |
| 3,948,019 | 4/1976 | Doring et al. . | |
| 3,952,479 | 4/1976 | Achelpohl . | |
| 4,033,096 | 7/1977 | Burgat et al. . | |
| 4,078,358 | 3/1978 | Henderson . | |
| 4,115,978 | 9/1978 | Langemeyer et al. . | |
| 4,156,334 | 5/1979 | Burgat et al. . | |
| 4,174,599 | 11/1979 | Callet et al. . | |
| 4,182,094 | 1/1980 | Lieder et al. . | |
| 4,320,615 | 3/1982 | Gmur . | |

*Primary Examiner*—James F. Coan

*Attorney, Agent, or Firm*—Harness, Dickey & Pierce

[57] ABSTRACT

The invention relates to an improved valve bag placing machine and method. The valve bag placing machine according to this invention is adapted to remove a valve type bag from a stack on an indexing conveyor, open the valve opening thereof, and insert this opening over a material dispensing nozzle of a bag filling machine. Vacuum cups, movable in response to actuation of pneumatic cylinders, contacts the valve bag at the end flap and side portions thereof. As these cylinders are retracted, a valve opening rod contacts the side of the bag to positively strip away the valve end flap from the side of the valve bag. Once in this position, one of the vacuum cups is removed from the bag and the valve bag clamping assembly is rotated by an actuator assembly. Prior to, after, or simultaneous with this rotation step, another pair of vacuum cups contacts the side of the valve bag and pulls it down with respect to the valve bag end flap, thus opening the valve bag valve opening. Once the valve opening is presented, the valve bag clamping assembly is caused to translate linearly such that the valve bag surrounds a material dispensing spout of the bag filling machine. At this point, vacuum to the various vacuum cups is relieved and the valve bag clamping assembly is returned to its initial position in registry with a valve bag on the indexing conveyor.

24 Claims, 6 Drawing Figures

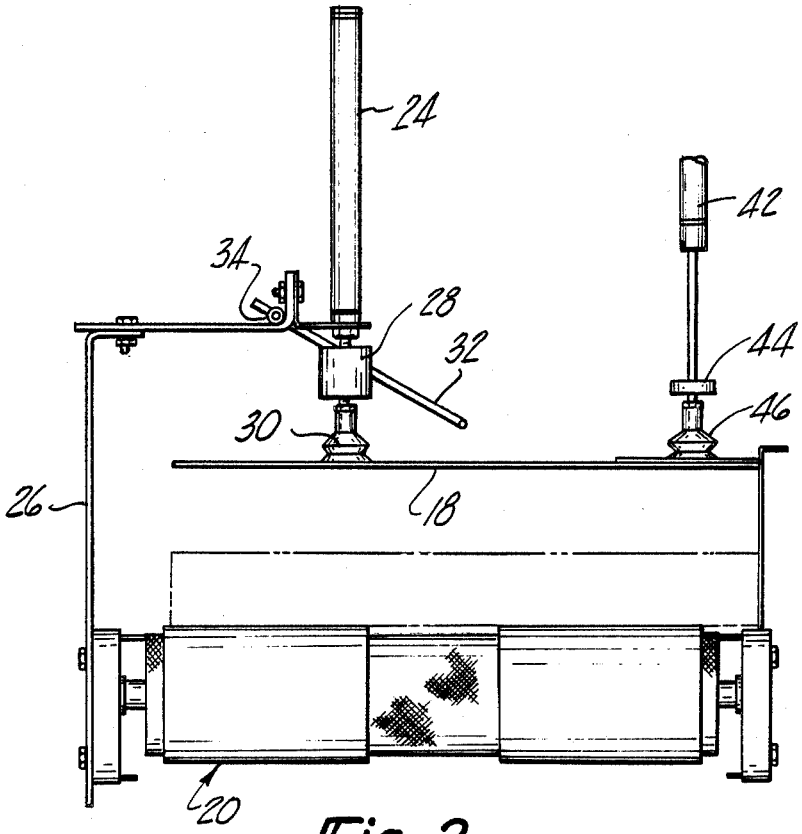
Fig-2
Fig-3
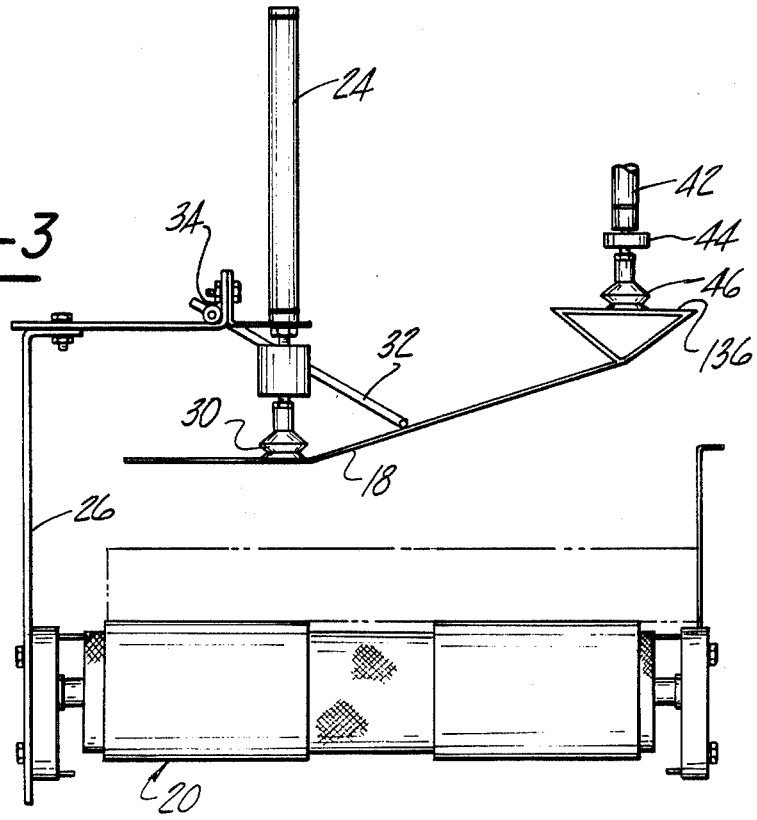

VALVE BAG PLACING MACHINE AND METHOD

BACKGROUND AND SUMMARY OF THE INVENTION

This invention relates to material handling, and particularly, to a machine and method for moving valve type bags from a conveyor into position with respect to a bag filling machine.

Valve type bags are typically made from paper and are folded to form an end flap having an opening at one end. Valve bags are used to contain numerous types of dry particulate materials such as cement, sand and edible products. The valve bag is filled by inserting the bag opening onto a material dispensing nozzle of a bag filling machine. Dry material is discharged through the nozzle filling the bag and is thereafter removed from the bag filling machine. Material within the bag remains within the valve bag since its presence within the bag exerts a closing force on the valve bag opening. Valve type bags are normally shipped in a folded and stacked condition. In certain instances, the bonding compounds used to fabricate the bag can prevent the end flap of the bag, which contains the valve opening, from being readily folded and opened. Therefore, to insure reliability, a valve bag placing machine must ensure that any bond between the bag end flap and the bag side is broken. Since valve bag placing machines are typically used in mass production commercial settings, it is further desirable that such machines be capable of high production rates, are reliable and which are low in cost and simple in construction. It is another desirable feature to enable such machines to be automatically controlled.

The above desirable features of a valve placing machine and method are provided in accordance with this invention. The valve placing machine includes a valve bag clamping assembly which is attached at the end of an arm which is rotatably and linearly movable by an actuator assembly. The valve bag clamping assembly includes vacuum cups which attach to the valve bag end. Additional vacuum cups attach to the bag side. Once attached, both these sets of vacuum cups are raised and a valve opening rod contacts the midsection of the valve bag between the points of contact of these vacuum cups to the bag. This contact by the valve opening rod effectively causes the bag end flap to be stripped away from the side of the bag. Thereafter, one of the vacuum cups is released and the valve bag clamping assembly is caused to rotate by the actuator assembly. After one of the vacuum cups is released, the valve bag clamping assembly, through articulated arms, causes bag engaging means to contact the bag side and pull open the valve opening. Thereafter, the carriage assembly moves the bag linearly such that the valve opening is placed around a material dispensing nozzle of the bag filling machine. The valve bag placing machine according to this invention is preferably automatically operated by an air logic system.

Additional benefits and advantages of the present invention will become apparent to those skilled in the art to which this invention relates from the subsequent description of the preferred embodiments and the appended claims, taken in conjunction with the accompanying drawings.

BRIEF DESCRIPTION OF THE DRAWINGS

FIG. 2 is an end view of several cylinders used to lift the valve bags showing the valve bags lifted to an intermediate position;

FIG. 3 is similar to FIG. 2 except that the cylinders are in a fully retracted position and the valve opening rod contacts the side of the valve bag to strip the valve bag end flap away from the bag side;

DETAILED DESCRIPTION OF THE INVENTION

The individual components of valve bag placing machine 10 will now be described in detail. The constituent components of valve placing machine 10 are first described below, followed by a description of the operation of the device and cooperation of the various elements.

Component Description

Figure 1:
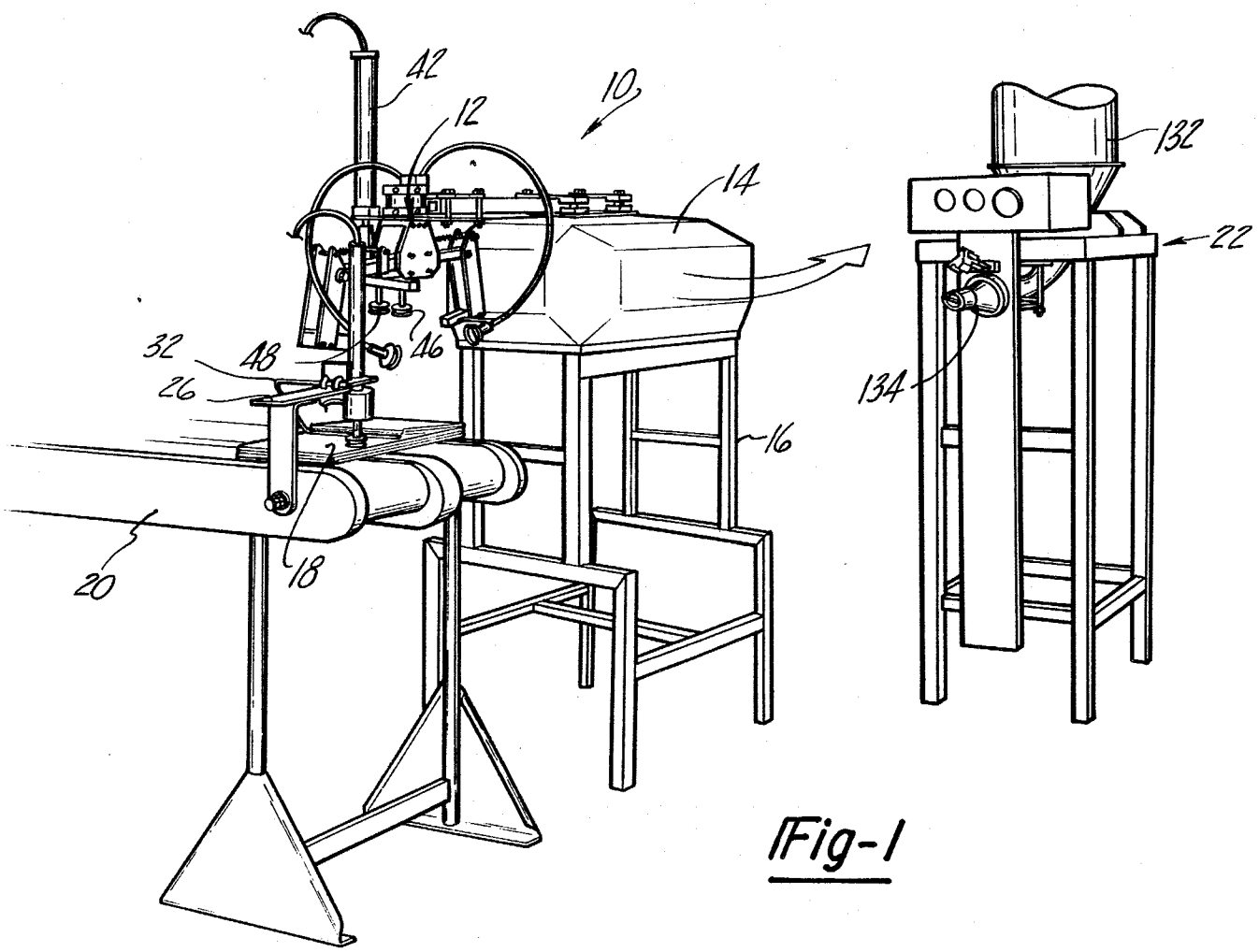
FIG. 1 is a pictorial view of the valve bag placing machine according to this invention shown in operating position with respect to a bag supplying indexing conveyor and a bag filling machine.

A valve bag placing machine according to this invention is shown completely assembled in FIG. 1 and is designated there by reference character 10. Generally, valve bag placing machine 10 includes actuator assembly 14 which positions valve bag clamping assembly 12. Actuator assembly 14 is affixed to stand 16. Valve bag placing machine 10 is employed to remove a stack of valve type bags 18 from a stack of valve bags from indexing conveyor 20, open the valve portion of the bag, and insert it onto bag filling machine 22. Once the flowable material is dispensed within valve bag 18 by bag filling machine 22, it is removed therefrom by additional material handling equipment. Indexing conveyor 20 is the type which automatically indexes to provide a fresh stack of valve bags 18 once a stack has been exhausted. The stacks of valve bags 18 are positioned in registry with valve bag placing machine 10.

The components of valve bag placing machine 10 used to lift bags 18 from the conveyor stack will now be described.

Cylinder 24 is mounted to bracket assembly 26 which is affixed to indexing conveyor 20. Bracket assembly 26 positions cylinder 24 at a position near one end of indexing conveyor 20. Cylinder 24 is preferably a pneumatically operated type having an internal slidable piston which responds to air pressure exerted thereto to cause actuation of a plunger rod. Attached to the protruding end of the plunger rod of cylinder 24, is weight 28 and vacuum cup 30. Vacuum cup 30 is in communication with a source of vacuum by a tube such that the vacuum cup can contact and adhere to the side portion of valve bag 18. Upon the supply of pressurized air to one side of the piston cylinder 24, vacuum cup 30 is caused to drop. Such dropping motion is aided by providing weight 28 connected to the plunger of cylinder 24. Upon the application of pneumatic pressure to the other side of the piston of cylinder 24, vacuum cup 30 is caused to raise as the plunger is retracted. Also attached to bracket assembly 26 is valve opening rod 32. Valve opening rod 32 is bent to a generally U-shape, as shown by FIGS. 1, 2 and 3. Valve opening rod 32 is attached to bracket assembly 26 by clamp 34 and its angular position with respect to bracket assembly 26 is preferably adjustable to ensure that it properly contacts the valve bag side to strip away the bag end flap, as will be subsequently described in detail.

Extending from actuator assembly 14 is a pair of arms 36 and 38. At the terminal ends of arms 36 and 38 are attached head mount plate 40 to which valve bag clamping assembly 12 is mounted. Also mounted to head mount plate 40 is cylinder 42 having bag pickup vacuum cup mount 44 attached to its slidable plunger rod. Bag pickup vacuum cup mount 44 provides a mounting location for a pair of vacuum cups 46 and 48 which, like vacuum cup 30, communicate with a source of pneumatic vacuum. Bag pickup vacuum cup mount 44 further acts as a manifold for the conduction of pneumatic vacuum to cups 46 and 48.

Valve bag clamping assembly 12 includes a pair of spaced plates 50 and 52 which form clamping arm housing 54. A pair of pivot pins 56 and 58 are positioned between plates 50 and 52. A pair of spur gears 60 and 62 are rotatable about pivot pins 56 and 58, respectively. Interposed between spur gears 60 and 62 and engageable therewith is double toothed rack 64. One end of toothed rack 64 is connected to the plunger of cylinder 66. Therefore, reciprocal motion of toothed rack 64 caused by actuation of cylinder 66 causes simultaneous rotation of spur gears 60 and 62.

Figure 5:
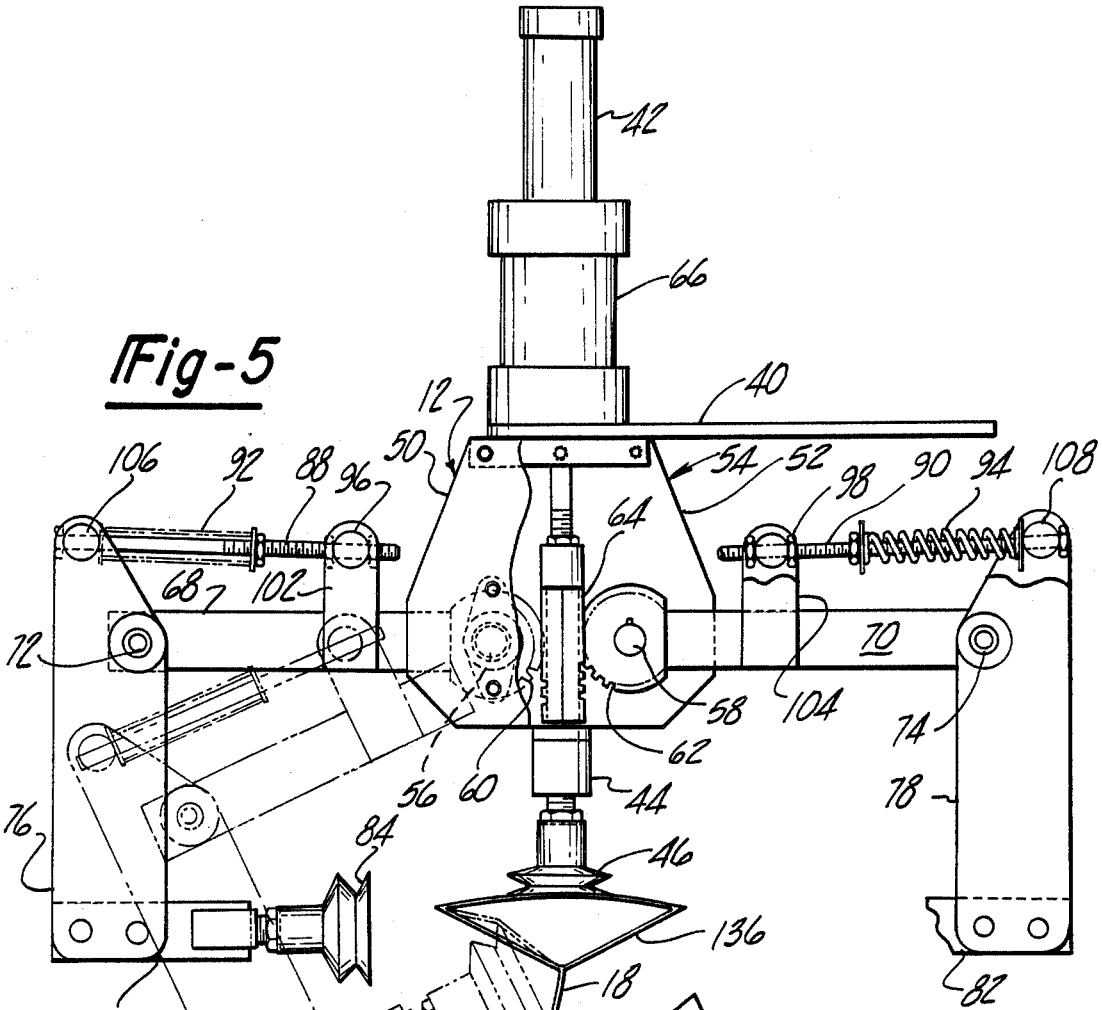
FIG. 5 is a side view of the valve bag clamping assembly shown in an intermediate position.
Figure 6:
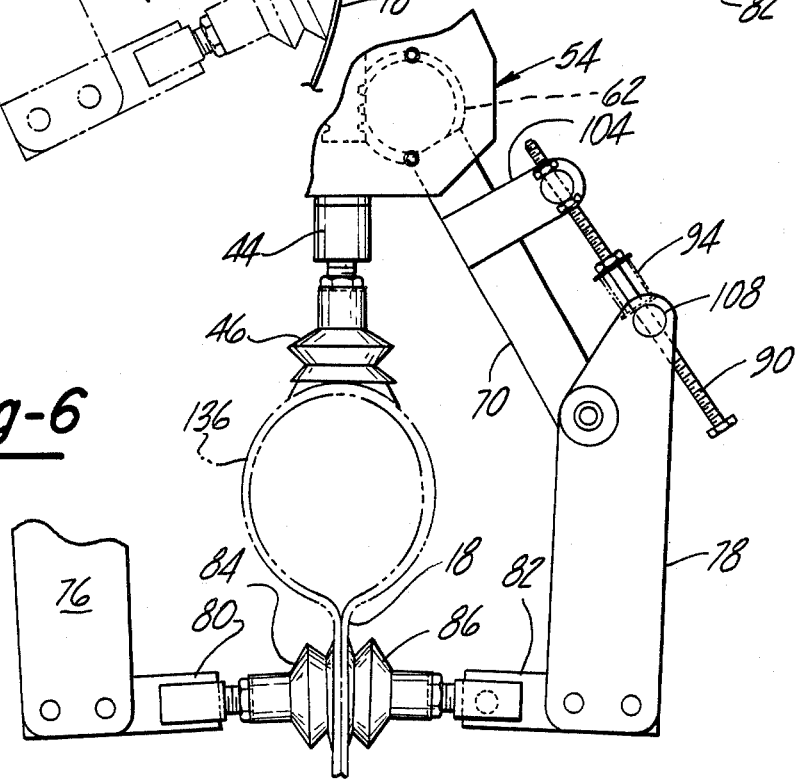
FIG. 6 is a partial side view of the valve bag clamping assembly shown in FIG. 5 in a second, final position wherein the valve opening of the valve bag is opened.

Rotary movement of spur gears 60 and 62 causes rotation of inside arms 68 and 70 which are connected to the spur gears. At the projecting ends of inside arms 68 and 70 are pivots 72 and 74 which rotatably attach outside arms 76 and 78. Outside arm 76 and 78 form opposing ends with pivots 72 and 74 positioned therebetween. The extreme ends of outside arms 76 and 78 provide mounting locations for vacuum cup mounts 80 and 82 to which vacuum cups 84 and 86 are attached. These vacuum cups are also connected to a supply of pneumatic vacuum. Alternatively, other types of bag engaging means, such as elastomeric buttons could be attached to outside arms 76 and 78. Outside arms 76 and 78 are rotatably biased about pivots 72 and 74 by the interaction between bolts 88 and 90, and coil springs 92 and 94. Bolts 88 and 90 are attached to pivots 96 and 98 which are connected to clamps 102 and 104 of inside arms 68 and 70. Bolts 88 and 90 are connected at their other ends to pivots 106 and 108 which are attached to outside arms 76 and 78. Coil springs 92 and 94 bias inside arms 68 and 70 with respect to outside arms 76 and 78 such that normally, approximately a 90° degree angle is formed between the arms, as is shown by FIG. 5. With reference to FIG. 6, outside arms 76 and 78 can be deflected with respect to inside arms 68 and 70 such that the angle formed therebetween exceeds 90°, resulting in compression of coil springs 92 and 94. As will be better explained subsequently, angular motion of inside arms 68 and 70 causes cups 84 and 86 to initially contact one another, and they then are moved away from clamping arm housing 54.

Figure 4:
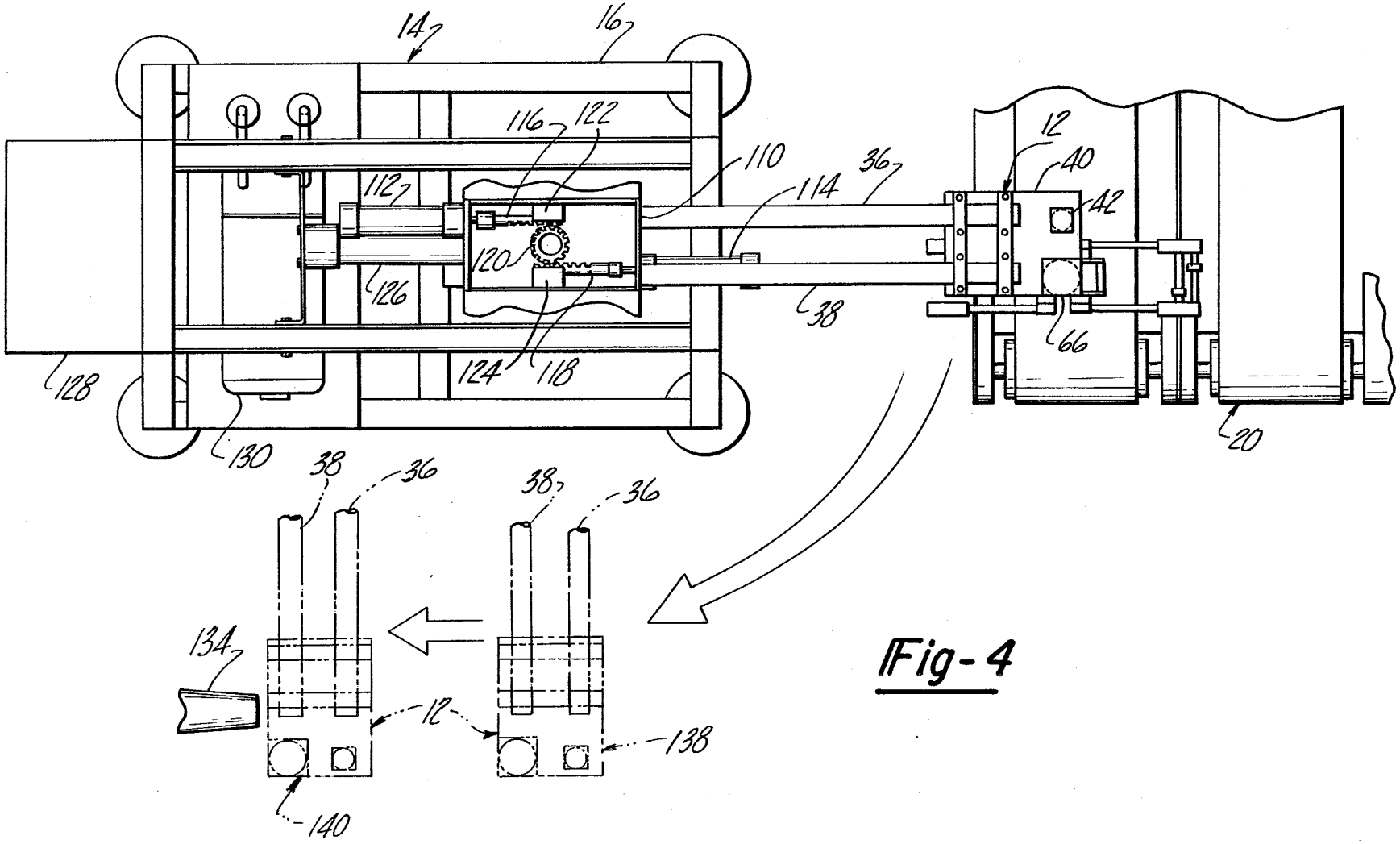
FIG. 4 is a top, partially cut away view of the actuator assembly of the valve bag placing machine according to this invention and further showing the valve bag clamping assembly in intermediate and final positions.

Now with particular reference to FIG. 4, actuator assembly 14 is shown in detail. Arms 36 and 38 are attached to rotating turntable 110 which is caused to rotate in response to actuation of cylinders 112 and 114. In a fashion similar to cylinder 66, cylinders 112 and 114 cause toothed racks 116 and 118 to reciprocate, causing relative rotation between them and spur gear 120. Cylinders 112 and 114 communicate with a controllable source of pneumatic pressure. Simultaneous extension of each of the plungers of cylinders 112 and 114 causes relative rotation of turntable 110 whith respect to the remainder of actuator assembly 14. Toothed racks 116 and 118 are positioned by their contact with sliding bearing blocks 122 and 124 such that they are maintained in intermeshing relationship with spur gear 120. Cylinder 126 is further provided which has its housing portion affixed to the frame of actuator assembly 14, and the protruding end of its slidable plunger in communication with turntable 110. Reciprocal actuation of cylinder 126 causes linear translation of turntable 110. The protruding ends of arms 36 and 38 are connected to valve bag clamping assembly 12.

Actuator assembly 14 provides a convenient mounting location for control system 128 and vacuum pump 130 which are necessary to actuate the various cylinders previously described in a timed and coordinated relationship. Control system 128 can be of any conventional type such as an air logic controller which automatically actuates the cylinders described above and supplies vacuum to the various vacuum cups in a coordinated and sequential manner.

Bag filling machine 22 is particularly shown by FIG. 1 and includes a material supply hopper 132. A valve mechanism is provided which controls flow of material from within hopper 132 through dispensing nozzle 134. Typically, a limit or proximity switch would be provided adjacent nozzle 134 to signal the presence of a valve bag 18 to initiate the bag filling operation.

Operation

The motion and coordination of the various elements previously described will now be discussed in detail. The initial position of the various components are shown by FIG. 1 wherein valve bag clamping assembly 12 is located in registry with an end of indexing conveyor 20. At this starting position, cylinders 24 and 42 are in a retracted position. Operation begins by causing both sets of vacuum cups 30, 46 and 48 to drop into contact with valve bag 18 which is on top of a stack of such bags on conveyor 20. Once in contact with valve bag 18, vacuum is supplied to vacuum cups 30, 46 and 48, thereby causing them to attach to the valve bag. Next, cylinders 24 and 42 are caused to retract such that the position depicted by FIG. 2 is reached wherein valve bag 18 is lifted from the top of the bag stack shown in phantom lines. Continued retraction of cylinder 42 results in the positioning of elements shown by FIG. 3 to be reached. When approaching the orientation shown by FIG. 3, valve opening rod 32 contacts a side surface of valve bag 18. This contact by valve opening rod 32 causes end flap 136 of valve bag 18 to be stripped away from the side of bag 18. This operation prevents any glue or other material which might be present between end flap 136 and the side of valve bag 18 from preventing the valve opening of the bag from being opened.

Having reached the position shown by FIG. 3, the vacuum supply to vacuum cup 30 is relieved by venting so that there is no longer a suction attracting force between vacuum cup 30 and valve bag 18. FIG. 4 is a top view showing the position of the components after completing the valve bag lifting step described above. Once vacuum to vacuum cup 30 is relieved, cylinders 116 and 118 are actuated, thereby causing rotation of turntable 110. Such rotation causes valve bag clamping assembly 12 and valve bag 18 attached thereto to be moved to the swivelled position indentified by reference character 138.

Simultaneous with undertaking motion of valve bag clamping assembly 12 from its initial to its swivelled position, immediately preceding or immediately thereafter, the valve opening of bag 18 is opened by bag clamping assembly 12. The description of this step is best made with reference to FIG. 5. FIG. 5 shows the initial position of inside arms 68 and 70 and outside arms 76 and 78. Actuation of cylinder 66 causes these arms to be rotated such that vacuum cups 84 and 86 are brought toward one another. Simultaneous with this motion of cups 84 and 86, a supply of vacuum is provided to those cups. Upon the completion of a predetermined degree of rotation of arms 68 and 70, vacuum cups 84 and 86 contact the side surfaces of valve bag 18. Continued rotation of spur gears 60 and 62 causes these vacuum cups to move downwardly with respect to vacuum cup 46 as the relative angular position of the inside and outside arm changes. Such changing of angular position is permitted through compression of springs 92 and 94. Therefore, the above operation causes vacuum cups 84 and 86 to contact and adhere to the sides of valve bag 18 and then pull the sides downwardly from the top surface of end flap 136. As shown by FIG. 6, this motion causes the valve opening of the valve bag to be opened.

Once the valve opening of valve bag 18 is presented, actuator assembly 14 is caused to translate linearly by actuation of cylinder 126. Such actuation causes translatory movement of valve bag clamping assembly 12 and the bag attached thereto from position 138 to position 140, also shown in phantom lines in FIG. 4, such that the valve opening of the bag is placed around material dispensing nozzle 134 of bag filling machine 22. It has been found that it is preferable from a reliability viewpoint to use purely linear motion in inserting valve bag 18 onto dispensing nozzle 134. Once placed in position with respect to dispensing nozzle 134, cylinder 66 can again be actuated to withdraw outside arms 76 and 78 from valve bag 18. Also, the vacuum source is to vacuum cups 84 and 86, and 46 and 48 can be relieved by venting. The entire system is indexed to place another valve bag 18 by reversing the motion of actuator assembly 14 by returning valve bag clamping assembly 14 to its original position, thereby repositioning valve bag clamping assembly 12 in registry with respect to indexing conveyor 20.

In the above description, the actuating cylinders are generally described as being of the double acting variety, i.e. the internal slidable piston is moved by air pressure in both reciprocal direction. However, as is well known to those skilled in the art to which this invention relates, other types of actuation devices including single acting devices could be used. When using a single acting device, motion in one direction could be achieved by taking advantage of gravity force to extend or retract the device, while the other reciprocal motion is caused by the application of air pressure or other force. The above specification also calls for the controlled application of vacuum to the several vacuum cups. Alternatively, vacuum could be continuously supplied to the cups even when they are not in contact with any portion of bag 18 or interrupted momentarily to cause them to release the bag.

While the above description constitutes the preferred embodiments of the present invention, it will be appreciated that the invention is susceptible to modification, variation and change without departing from the proper scope and fair meaning of the accompanying claims.

What is claimed is:

1. An apparatus for placing a valve bag having a valve opening, sides, and an end flap, said apparatus picking up said valve bag, opening said valve opening and placing said valve opening over a material dispensing nozzle, said apparatus comprising;

a bag clamping assembly including one or more first vacuum cups movable by a first actuator means, said first vacuum cups attachable to said end flap of said valve bag, said bag clamping assembly further including a pair of articulated arms movable by a second actuation means, said articulated arms having one or more bag engaging means attached thereto which are movable toward one another to contact opposite sides of said valve bag, said bag engaging means further movable away from said first vacuum cups thereby opening said valve opening, and a movable arm for positioning said bag clamping assembly in contact with said valve bag, rotating said valve bag and translating said bag such that said bag valve opening is placed over said material dispensing nozzle.

2. The apparatus for placing a valve bag according to claim 1 wherein said bag engaging means comprise one or more vacuum cups.

3. The apparatus for placing a valve bag according to claim 1 wherein said first and second actuation means comprise pneumatic cylinders.

4. An apparatus for placing a valve bag having a valve opening, sides, and an end flap, said apparatus picking up said valve bag, opening said valve opening and placing said valve opening over a material dispensing nozzle, said apparatus comprising;

a bag clamping assembly including one or more first vacuum cups movable by a first actuator means, said first vacuum cups attachable to said end flap of said valve bag, said bag clamping assembly further including a pair of articulated arms movable by a second actuation means, said articulated arms having one or more bag engaging means attached thereto which are movable toward one another and away from said first vacuum cups thereby engaging said bag sides and opening said valve opening, said pair of articulated arms each including a pair of inside arms attached to spur gears rotatable within a clamping arm housing, said second actuation means causing translation of a toothed rack, said toothed rack meshing with said spur gears thereby causing rotation of said spur gears and said inside arms as said toothed rack is translated, said inside arms pivotably attached to a pair of outside arms, said bag engaging means attached to said outside arms and biasing means biasing said inside and outside arms toward a predetermined angular relationship, and a movable arm for positioning said bag clamping assembly in contact with said valve bag, rotating said valve bag and translating said bag such that said bag valve opening is placed over said material dispensing nozzle.

5. The apparatus for placing a valve bag according to claim 4 wherein said predetermined angular relationship exist when said inside and said outside arms extend along axes inclined 90° with respect to each other.

6. The apparatus for placing a valve bag according to claim 4 wherein said biasing means comprises a coil spring acting upon a bolt attached to said inside and said outside arms.

7. The apparatus for placing a valve bag according to claim 1 further comprising: an actuator assembly for moving said bag clamping assembly, said actuator assembly having a turntable attached to said arm, said actuator having one or more actuation means moving one or more toothed racks intermeshing with a second spur gear whereby translation of said one or more toothed racks causes rotation of said turntable with respect to said actuator assembly, said actuator assembly further having an actuation means for causing translation of said actuator assembly.

8. An apparatus for placing a valve bag having a valve opening, sides, and an end flap, said apparatus picking up said valve bag, opening said valve opening and placing said valve opening over a material dispensing nozzle, said apparatus comprising;

a bag clamping assembly including one or more first vacuum cups movable by a first actuator means, said first vacuum cups attachable to said end flap of said valve bag, said bag clamping assembly further including a pair of articulated arms movable by a second actuation means, said articulated arms having one or more bag engaging means attached thereto which are movable toward one another and away from said first vacuum cups thereby engaging said bag side and opening said valve opening, one or more second vacuum cups movable in response to a third actuation means for attaching to said valve bag side, a valve opening rod for contacting said valve bag side at a position between the points of attachment of said first and second vacuum cups to said valve bag, said valve opening rod separating said valve bag end flap from said bag side, and a movable arm for positioning said bag clamping assembly in contact with said valve bag, rotating said valve bag and translating said bag such that said bag valve opening is placed over said material dispensing nozzle.

9. The apparatus for placing a valve bag according to claim 8 wherein said bag engaging means comprise one or more third vacuum cups.

10. The apparatus for placing a valve bag according to claim 8 wherein said first, second and third actuation means comprise pneumatic cylinders.

11. The apparatus for placing a valve bag according to claim 9 wherein said first, second and third vacuum cups are connected to a source of vacuum.

12. The apparatus for placing a valve bag according to claim 8 wherein said pair of articulated arms each include a pair of inside arms attached to spur gears rotatable within a clamping arm housing, said second actuation means causing translation of a toothed rack, said toothed rack meshing with said spur gears thereby causing rotation of said spur gears and said inside arms as said toothed rack is translated, said inside arms pivotably attached to a pair of outside arms, said third vacuum cups attached to said outside arms and biasing means biasing said inside and outside arms toward a predetermined angular relationship.

13. The apparatus for placing a valve bag according to claim 12 wherein said predetermined angular relationship exist when said inside and said outside arms extend along axes inclined 90° with respect to each other.

14. The apparatus for placing a valve bag according to claim 12 wherein said biasing means comprises a coil spring acting upon a bolt attached to said inside and said outside arms.

15. The apparatus for placing a valve bag according to claim 8 wherein said third actuation means is attached to a fixed bracket.

16. The apparatus for placing a valve bag according to claim 8 wherein said valve opening rod is attached to a fixed bracket.

17. The apparatus for placing a valve bag according to claim 8 further comprising: an actuator assembly for moving said bag clamping assembly, said actuator assembly having a turntable attached to said arm, said actuator having one or more fourth actuation means moving one or more toothed racks intermeshing with a second spur gear whereby translation of said one or more toothed racks causes rotation of said turntable with respect to said actuator assembly, said actuator assembly further having a fifth actuation means for causing translation of said actuator assembly.

18. The apparatus for placing a valve bag according to claim 16 wherein said fourth and fifth actuation means comprise pneumatic cylinders.

19. The apparatus for placing a valve bag according to claim 8 further comprising control means for controllably and sequentially providing control signals to said actuation means and vacuum signals to said vacuum cups.

20. The apparatus for placing a valve bag according to claim 18 further comprising control means for controllably and sequentially providing control signals to said actuation means and vacuum signals to said vacuum cups.

21. A method of placing a valve bag having a valve opening, sides, and an end flap from a stack to a material dispensing nozzle such that said nozzle is inserted within said valve opening comprising the steps of;

attaching one or more vacuum cups to said bag end flap, lifting said vacuum cups, rotating said bag from a first initial position to a second angularly displaced second position, moving bag engaging means into contact with each of said bag sides, moving said bag engaging means away from said first vacuum cups thereby opening said valve opening, linearly moving said bag from said second position to a third position wherein said valve opening is placed over said material dispensing nozzle, and releasing said vacuum cups and said bag engaging means from said valve bag.

22. A method of placing a valve bag having a valve opening, side, and an end flap from a stack to a material dispensing nozzle such that said nozzle is inserted within said valve opening comprising the steps of;

attaching one or more first vacuum cups to said bag end flap, attaching one or more second vacuum cups to one of said bag sides, lifting said first vacuum cups, lifting said second vacuum cups, placing a valve opening rod against said bag side at a position between the points of attachment of said first and third vacuum cups thereby separating said bag end flap from said bag side, releasing said second vacuum cups, rotating said bag from a first initial position to a second angularly displaced second position, moving bag engaging means into contact with each of said bag sides, moving said bag engaging means away from said first vacuum cups thereby opening said valve opening, linearly moving said bag from said second position to a third position wherein said valve opening is placed over said material dispensing nozzle, and releasing said first vacuum cups from and said bag engaging means said valve bag.

23. The method according to claim 22 wherein said first vacuum cups are lifted a first distance and wherein said second vacuum cups are lifted a second distance, said first distance being greater than said second distance.

24. A method of placing a valve bag having a valve opening, side, and an end flap from a stack to a material dispensing nozzle such that said nozzle is inserted within said valve opening comprising the steps of;

activating a first actuation means causing one or more first vacuum cups to lower into contact with said bag end flap, communicating a source of vacuum to said first vacuum cups, causing said first vacuum cups to attach to said bag end flap, actuating a third actuation means, causing one or more second vacuum cups to lower into contact with one of said bag sides, communicating a source of vacuum to said second vacuum cups causing said second vacuum cups to attach to one of said bag sides, actuating said first and third actuation means causing said first and second vacuum cups to be raised, placing a valve opening rod against said bag side at a position between the points of attachment of said first and second vacuum cups thereby separating said bag end flap from said bag side, venting said second vacuum cups thereby causing them to release said bag side, actuating a fourth actuation means causing said bag to be moved from a first position to a second angularly displaced second position, actuating a second actuation means causing bag engaging means to engage each of said bag sides, further actuating said second actuation means causing said bag engaging means to be moved away from said first vacuum cups thereby opening said valve opening, actuating a fifth actuation means causing said valve bag to be linearly moved from said second position to a third position wherein said valve opening is placed over said material dispensing nozzle, venting said first vacuum cups thereby causing said first vacuum cup to release said bag, and actuating said second actuation means causing said bag engaging means to be moved away from said bag sides.

* * * * *

UNITED STATES PATENT AND TRADEMARK OFFICE

CERTIFICATE OF CORRECTION

PATENT NO. : 4,577,454

DATED : March 25, 1986

INVENTOR(S) : Paul R. Wright, et al.

It is certified that error appears in the above-identified patent and that said Letters Patent is hereby corrected as shown below:

Column 2, line 66, After "piston", insert --of--.

Column 4, line 8, "whith" should be --with--.

Column 5, line 6, "indentified" should be --identified--.

Column 5, line 57, "direction" should be --directions--.

Column 7, line 3 (claim 5), "exist" should be --exists--.

Column 8, line 3 (claim 13), "exist" should be --exists--.

Column 8, line 60 (claim 22), "side" should be --sides--.

Column 9, line 16 (claim 22), After "cups", delete --from--.

Column 9, line 17 (claim 22), After "means", insert --from--.

Column 9, line 24 (claim 24), "side" should be --sides--.

Signed and Sealed this

*Twenty-sixth* Day of *August 1986*

[SEAL]

*Attest:*

DONALD J. QUIGG

*Attesting Officer*

*Commissioner of Patents and Trademarks*